United States Patent [19]

Kondur et al.

[11] 3,993,884

[45] Nov. 23, 1976

[54] DETACHABLY MOUNTED KEYBOARD PUSHBUTTON ACTUATORS AND HOUSING ASSEMBLY

[75] Inventors: Nicholas Kondur, Rolling Meadows; Peter Scheuzger, Highland Park; Marshall S. Joseph, Chicago, all of Ill.

[73] Assignee: Victor Comptometer Corporation, Chicago, Ill.

[22] Filed: Sept. 15, 1972

[21] Appl. No.: 289,449

[52] U.S. Cl. ..... 200/295; 200/338; 200/340

[51] Int. Cl.[2] ..... H01H 3/12; H01H 9/00; H01H 13/00

[58] Field of Search ..... 200/153 V, 159 B, 159 H, 200/159 R, 172 A, 153 T, 168 B, 168 C, 77, 153, 159, 330, 340, 295, 338

[56] References Cited

UNITED STATES PATENTS

| | | | |
|---|---|---|---|
| 3,213,189 | 10/1965 | Mitchell et al. | 200/168 C X |
| 3,309,487 | 3/1967 | Fisher | 200/172 A |
| 3,582,594 | 6/1971 | Twyford | 200/340 |
| 3,668,356 | 6/1972 | Kekas | 200/172 A |
| 3,773,997 | 11/1973 | Evaus et al. | 200/159 B |
| 3,829,632 | 8/1974 | Klehm, Jr. | 200/159 B X |

FOREIGN PATENTS OR APPLICATIONS

| | | | |
|---|---|---|---|
| 1,222,139 | 8/1966 | Germany | 200/153 T |

*Primary Examiner*—James R. Scott
*Attorney, Agent, or Firm*—McCaleb, Lucas & Brugman

[57] ABSTRACT

Universal keyboard with individually removable switch modules each adapted particularly for use with a printed circuit switch, although also adapted to close or actuate other types of switch contacts, which has maximum reliability at minimum cost, satisfies the "best feel" tactile responses desired in a keyboard, while fully protecting the module components and the electrical conducting members against any excessive finger depression impact forces, assures uniformity of forces being applied to switch contacts regardless of variations in forces which may be applied to the key buttons or stems, reduces electric contact bounce, and maximizes the time the switch contacts are held closed during a key stroke.

19 Claims, 8 Drawing Figures

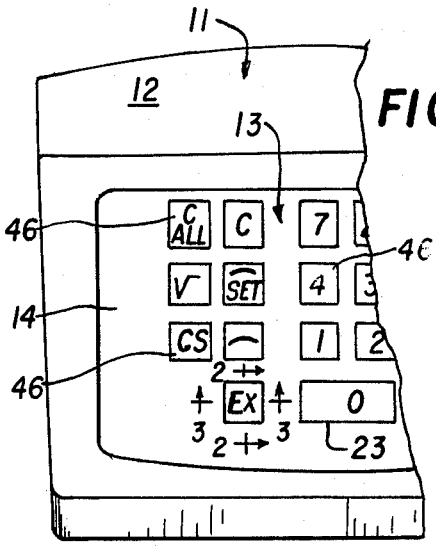
FIG. 1
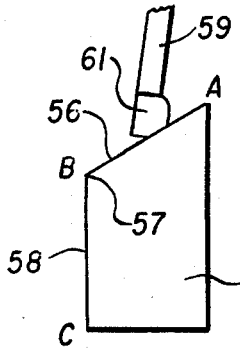
FIG. 6
FIG. 7
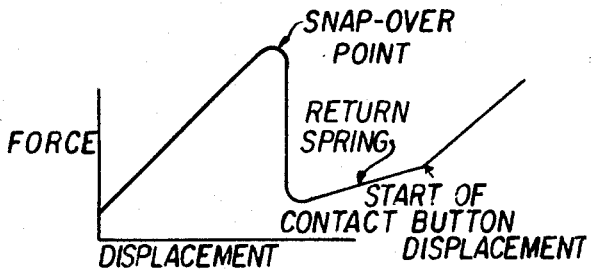
FIG. 4
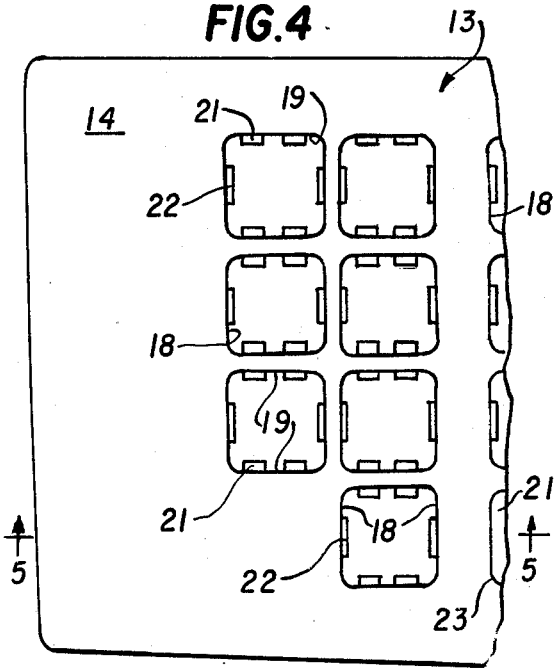
FIG. 8
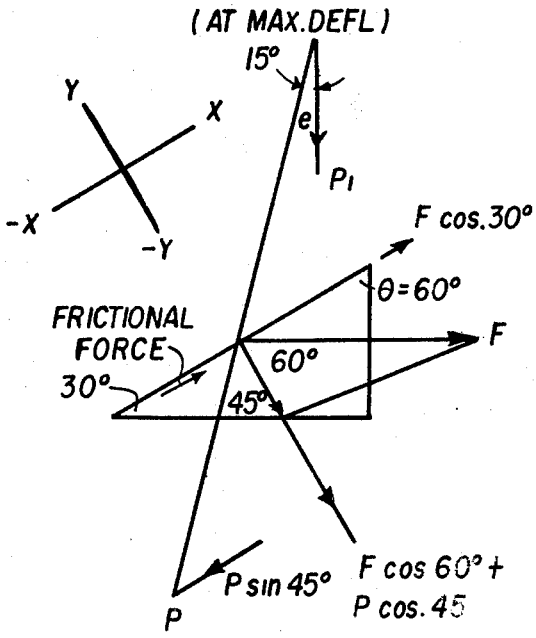
FIG. 5
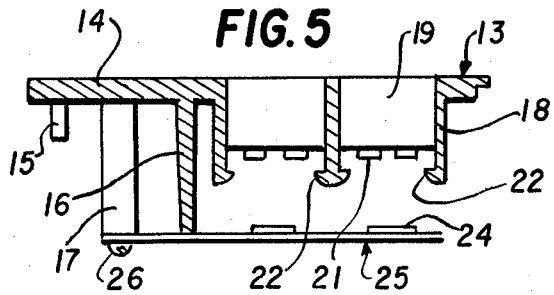

DETACHABLY MOUNTED KEYBOARD PUSHBUTTON ACTUATORS AND HOUSING ASSEMBLY

BACKGROUND OF THE INVENTION

1. Field of the Invention

This invention relates generally to keyboards and more particularly to universal keyboards for use especially with electronic calculators and peripheral computer equipment.

2. Description of the Prior Art

Pressure-sensitive diaphragm switches are known, such as that disclosed in U.S. Pat. No. 3,308,253 having a substrate with a segment of conductive material plated on its upper surface, a layer of incompressible insulating material thereover with an opening over the conducting segment, a superposed diaphragm with a conductive segment on its underside over the opening, and a top layer of elastomeric material, whereby application of force by a stylus over the opening depresses the elastomeric material, the diaphragm and its conductive segment to contactingly engage the latter with the conducting segment on the substrate. And as noted in U.S. Pat. No. 3,617,660, efforts have been made to include such diaphragm switches in keyboard designs, but the resulting devices do not effect uniform and completely reliable switch closings, are difficult if not impossible to repair, are expensive, and do not give the "best feel" tactile response and customary keyboard appearance preferred by operators.

SUMMARY OF THE INVENTION

The present invention provides a truly universal keyboard which is inexpensive to make and repair because it is made up almost entirely of plastic and comprises a cover member having integrally formed aperture-defining means positioning and engaging readily replaceable and unique mechanical switch-operating modules. Each such module is made up of a body having means formed integrally therewith for effecting snap-fit engagement with the cover member, a vertically slidable plastic key stem, and stop means limiting movement of the key stem relative to the body. The key stem also carries a contact button on its lower end for limited vertical movement relative thereto, with a spring normally maintaining it in extended position to close an associated switch when the key stem is depressed, and the latter has a return spring normally maintaining the key stem in raised position. Only these two springs are made of metal.

Human factors studies in keyboard design have determined that the "best feel" response to key depression is a sudden and well-defined change in resistance pressure accompanied by an audible signal. To effect this desired response, each switch-operating module comprises interengaging means forming part of the body and the key stem to incrementally increase resistance to key depression through approximately the first half of a key stroke to a snap-over point and thereafter offering a reduced or minimal resistance. This interengaging means comprises wedge means on the body defining a cam surface sloping downwardly and outwardly relative to the vertical axis of the key stem joining a vertical surface at is lower edge as the snap-over point, and a cantilever leaf integral with the key stem having a free lower end slidably engaging that wedge means.

When the keyboard of this invention is mounted in superposed relationship to conductive elastomer diaphragms bridging plated conductors on a printd circuit board, or oher normally open switch means, the spring-loaded contact button having a tip with a spherical radius of ½ to 4 inches provides a uniform depression force, reduces undesired contact bounce, and allows greater contact time than would be provided by a solid key stem. The stop means referred to as limiting movement of the key stem relative to the module body, together with a top key button on the stem which limits movement of the key stem relative to the cover member, prevent transmission of excessive finger depression impct forces to the switch-operating module or the switch means operated thereby.

IN THE DRAWINGS

FIG. 1 is a plan view of a portion of a machine incorporating a keyoard embodying the invention;

FIGS. 2 and 3 are vertical detail sections through one of the switch-operating modules taken substantially on the lines 2—2 and 3—3, respectively, of FIG. 1, on an enlarged scale;

FIG. 4 is a plan view of an end portion of the keyboard cover member;

FIG. 5 is a detail vertical section taken substantially on the line 5—5 of FIG. 4;

FIG. 6 is a diagrammatic end view of the lower end of a key stem cantilever leaf engaging the sloping cam surface of the module body wedge means;

FIG. 7 is a graphic force-displacement curve for a switch-operating module; and FIG. 8 is a free-body diagram of the cooperating leaf and cam surface of FIG. 6.

DESCRIPTION OF THE PREFERRED EMBODIMENT

Figure 3:
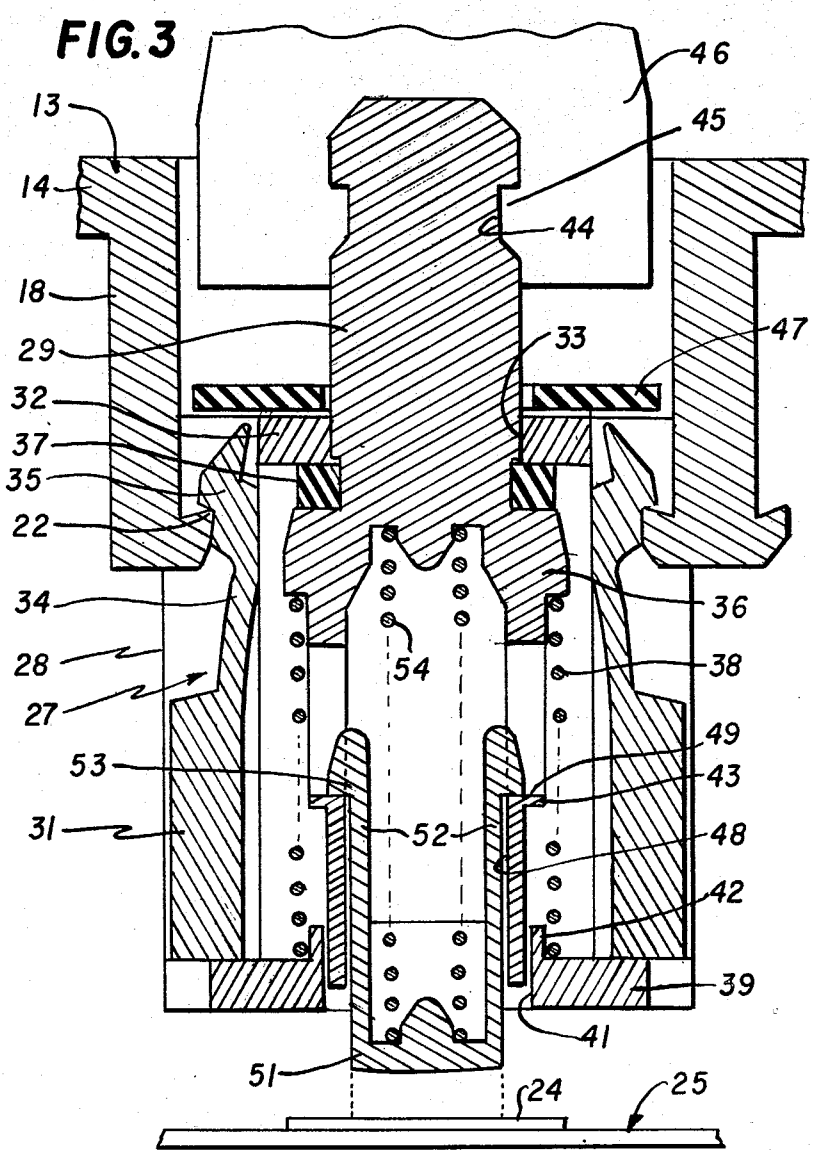

Referring more paticularly to the drawings, reference numeral 11 inicates in general an electronic calculator, or the like, which comprises a casing 12 housing its component parts and including a suitable aperture for receiving a keyboard cover 13. This cover 13 includes a horizontal top plate 14, positioning lugs 15 (FIG. 5) depending therefrom for cooperation with the casing 12, vertically depending walls 16 enclosing a horizontally rectangular space, a plurality of studs 17 suitably vertically apertured at their lower ends, and a plurality of aperture-defining means, all formed integrally of a suitable molded plastic.

As seen in FIGS. 4 and 5, each such aperture-defining means comprises opposed sidewalls 18 and opposed top and bottom or end walls 19, together defining a continuous flange circumscribing a rectangular space or aperture in the top plate 14. The lower ends of walls 19 terminate in horizontal inwardly extending tabs 21 (FIG. 2), and the walls 18 are provided at their lower ends with inwardly extending horizontal shelves 22 (FIG. 3).

The positioning, dimensioning and locations of these aperture-defining means 18, 19, 21, 22 are determined by the overall characteristics and design of the particular keyboard involved, most being square and some being elongated, as at 23 in FIG. 1 for a zero key in a 10-key portion of the keyboard, and others of the function keys (not shown). It will be understood that tabs 21 in such an elongated aperture-defining means may be extended or enlarged and also provided with key button guiding means formed integrally therewith if desired. In any event, the individual aperture-defining means 18–22 are vertically aligned with normally open switch means 24 (FIG. 2, 3 and 5) which in this embodiment each comprises a conductive elastomer diaphragm bridging plated conductors on a printed circuit board assembly 25 aligned with a hole in an apertured dielectric separator. It will be appreciated that the details of such circuit board assembly 25 do not constitute a part of this invention, it being sufficient to understand that such switching technique comprises completing a switch circuit by depressing the diaphragm 24, and that the instant keyboard may just as well be employed with other forms of switch means.

As shown in FIG. 5, the switch assembly 25 is attached to the keyboard cover 13 and held against the lower ends of the walls 16 and studs 17 by screws 26 threaded into the apertures in the lower ends of the studs.

Referring again specifically to FIGS. 2 and 3, a switch-operating module indicated generally by reference numeral 27 is removably mounted in each of the aperture-defining means 18, 19, 21, 22. Each switch operating module 27 comprises a body 28 and a key stem 29. The body 28 includes sidewalls 31 joined at their upper ends by an upper plate 32 having a central vertical aperture 33 for slidably receiving the key stem 29. The upper central portion of each sidewall 31 is formed to provide a cantilever hook 34 (FIG. 3) with a nose 35 at its free upper end extending outwardly to engage an associated horizontal shelf 22 of the aperture-defining means of the keyboard cover 13, thereby to effect snap-fit engagement in a selected aperture-defining means 18-22 to permit automatic engagement of the noses 35 of the two cantilever hooks 34 at the opposite sides of the body 28 with the shelves 22. It will be appreciated that the horizontal tabs 21 extending inwardly from the end walls 19 of the keyboard cover engage the sidewalls 31 of the module body 28 and, at their inner ends, the edges of the upper plate 32 to accurately locate the switch-operating module and retain its body 28 in operative position in the apperture-defining means of the cover member 13.

Figure 2:
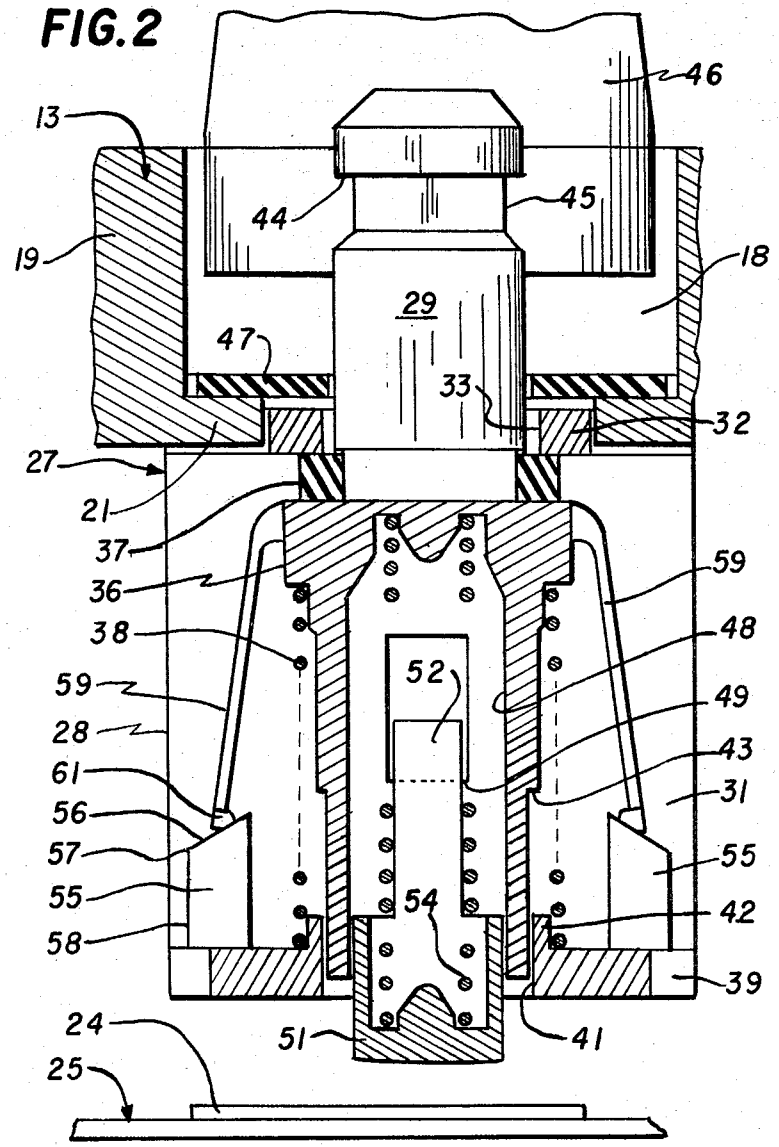

The key stem 29 is provided with an upper portion guided by and vertically slidable in the aperture 33 in the upper plate 32 of the body 28 and, as shown in FIGS. 2 and 3, is formed with flange means 36 intermediate its ends on the upper surface of which is mounted a suitable return bumper 37 for key stem limiting engagement with the lower surface of the upper plate 32 in response to key-elevating action of a return coil spring 38 that is mounted on the key stem with its upper end engaging the lower surface of the flange means 36. The lower end of the spring 38 rests upon a bottom plate 39 which, after assembly of the members 28, 29, 37, and 38, is secured to the lower end of the body 28, as by ultrasonic welding. The bottom plate 39 has a central aperture 41 for guiding vertical movements of the key stem 29 and an upstanding flange 42 surrounding that aperture for positioning the lower end of the return spring 38 and cooperating with an annular shoulder 43 on the key stem 29 to limit downward movement of the key stem relative to the module body 28.

The upper end portion of the key stem 29 is chamfered and provided in spaced relationship thereto with side grooves 44 for receiving complementary lugs 45 in a bottom aperture provided in a key button 46, whereby the key button has a snap-fit engagement on the upper portion of the stem 29. It will be appreciated that appropriate indicia are inscribed on the upper surfaces of the different key buttons 46 in well-known manner. A thin bumper washer 47 of suitable shock-absorbing characteristics preferably is first dropped over the upper end of the key stem 29 after the module 27 has been moved upwardly into mounted position in the cover member 13 and before the snap mounting of the key button 46 on the stem so as to be interposed between the lower surface of the key button 46 and the tabs 21. This results in the downward movements of the key button 46 being limited by the cover member 13 and the interposed bumper washer 47 to prevent the transmission of any excessive finger depression impact forces to the switch-operating module 27 from its key button 46 or to the switch means 24 operated thereby.

To effect the switch-operating function, the lower portion of the key stem 29 is hollowed to provide a bore 48, and apertured to present opposed ledges 49 which, as shown in FIG. 3, comprise inward extensions of the upper surfaces of the annular shoulder 43. Slidable upwardly into this lower tubular end of the key stem 29 is a contact button 51 having upstanding and opposed cantilever fingers 52 with outwardly extending lugs 53 that will spring automatically outwardly into these apertures provided in the wall of the key stem 29. A coil spring 54 is mounted in the key stem with its upper end engaging the later and its lower end engaging the contact button 51. The function of this contact button spring means 54 is to normally maintain the contact button 51 in its extended position of the drawings with the lugs 53 thereby held in engagement with the ledges 49.

Upon key depression of the stem 29 from its normally raised position of the drawings, the contact button 51 will be carried downwadly through the agency of this contact button spring means 54 to close the associated switch means 24. In this connection and in order to give the most satisfactory results, the lower suface of the contact button 51 is given a spherical radius in the range of ½ to 4 inches. After the button 51 first physically contacts switch means 24 during key depression, further downward movement of the key stem 29 will be relative to the contact button, and the latter will be held in operative position by the contact button spring means 54. Upon release of the key button 46, the key stem 29 will be raised back to normal position by the return spring 38 and this will carry the contact button 51 back to its normal inoperative position through the agency of the ledges 49 and the lugs 53. This arrangement thus provides the application of a uniform depression force by the contact button 51 on the switch means 24, reduces electrical contact bounce and allows a much greater contact time during a key stroke than would be effected by a unitary key stem. As in the case of mounting of the switch-operating module 27 in the keyboard cover 13, snap-fitting of the contact button 51 onto the lower tubular section of the key stem 29 provides a simple, economical and rapid means of assembling the parts and enabling dis-assembling thereof whenever necessary and wihout requiring the use of any tools.

In order to effect the desired "best feel" response to depression of the key button 46, the switch-operating module 27 is provided with interengaging means forming part of the body 28 and the key stem 29. With respect to the body 28, this interengaging means comprises wedge means 55 formed integrally therewith at each of the lower four corners of the sidewalls 31. As best seen in FIG. 2, each of these wedge means 55 comprises a slanting cam surface 56 sloping downwardly and outwardly relative to the vertical axis of the key stem 29 and terminating in a lower edge 57 in a vertical surface 58 joining and depending from the slanting cam surface 56. In FIG. 6 the slanting cam surface 56 is illustrated as extending from A to B, and the vertical surface 58 as extending from B to C, with lower edge 57 coinciding with that point of juncture B.

With respect to the key stem 29, the interengaging means heretofore noted comprises a pair of opposed cantilever leafs 59 formed integrally with the key stem and extending downwardly and outwardly from the flange means 36. At its lower free end, each of the cantilever leafs 59 is provided with a pair of transversely extending fingers 61 normally resting upon and in contact with the cam surface 56 of the associated wedge means 55.

As will be appreciated from FIGS. 2 and 6, the interengaging means comprising the cantilever leafs 59 and the wedge means 55 at opposite sides of the module will effect incrementally increasing resistance to downward movement of the key stem 29 relative to the body 28 through approximately the first half of a complete key stem depression until the fingers 61 of the cantilever leaves 59 come to the lower edge 57 of the associated wedge means 55 which constitutes a snap-over point. Thereafter, minimal resistance throughout the remaining portion of a complete key depression will be offered by this interengaging means by virtue of fingers 61 of the cantilever leaves 59 merely moving along the vertical surface 58.

FIG. 7 shows the general force-displacement curve of the instant switch-operating module 27 during a downward key stroke and indicating one of the many combinations of force versus displacement relationships possible with this design. As will be seen therefrom, as downward displacement of the key stem 29 takes place (toward the right therein), the kinesthetic feedback or resistance forces resulting from flexure of the cantilever leaves 59 as their fingers 61 move downward and outwardly along the cam surfaces 56 of the edge means 55 will increase. When the fingers 61 reach the snap-over point B of FIG. 6 defined by the associated cam edges 57, the resistance force drops off perceptively (as illustrated in FIG. 7) and continued downward displacement of the key stem finally results in added force resistance due to the compressing of the return spring 38, and compressing the contact button spring means 54 when the key stem 29 is moved downwardly relative to the contact button 51.

As previously noted, all parts of the switch-operating module 27, except the springs 38 and 54, but including the body 28, bottom plate 39 and contact button 51, are molded thermoplastic material, "NORYL" thermoplastic manufactured by General Electric Company having been found to be satisfactory. The key stem 29 is made of a molded acetal resin because of its excellent fatigue endurance properties, dmensional stability, natural lubricity and useful temperature range.

FIG. 8 shows a free-body diagram of the contact area of a leaf end or finger 61 while engaged with the angular cam surface 56 of the associated wedge means 55, where:

$P_1$ = vertical force required to push downward to overcome force of cantilever leaf 59 and friction between 56 and 61

$P$ = force longitudinally through cantilever leaf 59 required to overcome force of cantilever leaf 59 and friction between 56 and 61

$\theta$ = edge angle = 60° for specific embodiment illustrated $u$ = coefficient of friction (approximately 0.125 for the specific embodiment illustrated and $F$ = cantilever leaf force at any lateral deflection distance.

Taking a summation of forces in the X direction in FIG. 8:

$P \sin 45° = F \cos 30° + u\,F \cos 60° = u\,P \cos 45°$ and $P$ is mathematically defined by the equation $$P + F\,\frac{(\cos 30° + u \cos 60°)}{(\sin 45° - u \cos 45°)}.$$

Also $P_1 = P \cos e$ and since $e$ is relatively small, $P_1$ is approximately equal to $P$.

For the wedge angle and materials identified, P is approximately equal to F (1.167).

This relationship holds true as long as the cantilever leaf end 61 is sliding along the cam surface 56, A–B in FIG. 6.

After snap-over with the leaf end or finger 61 moving along the vertical surface 58, B–C in FIG. 6, the relationship changes to $$P = F\,u \text{ or } P = F\,(0.125),$$

and as previously noted, as the leaf end or finger 61 passes the edge 56 is where the sudden drop off in finger pressure occurs.

Since there are two cantilever leaves 59, the total finger pressure required in depressing the key stem is twice that given above, plus the lesser resistive force supplied by the return spring 38 and, in the latter part of the key stroke, by the contact button return spring 54.

It is thought that the invention and many of its attendant advantages will be understood from the foregoing description, and it will be apparent that various changes may be made in the form, construction and arrangement of the parts without departing from the spirit and scope of the invention or sacrificing all of its material advantages, the form hereinbefore described being merely a preferred embodiment thereof.

We claim:

1. A keyboard for selectively closing a plurality of normally open switch means, comprising a rigid cover member overlying said switch means and having aperture-defining means formed integrally therewith respectively aligned with individual said switch means, and a switch-operating module individually removably mounted in each said aperture-defining means, comprising a body insertable into the latter and having means effecting snap-fit engagement therewith, a key stem vertically slidable in said body and depressible when the latter is mounted in said cover member to close the associated said switch means, return spring means separate from and interposed between said key stem and said body for normally maintaining said key stem in raised position, and stop means positively limiting movements of said key stem relative to said body.

2. In a keyboard according to claim 1, interengaging means forming part of each said body and its associated said key stem to effect a best feel response to key depression by incrementally increasing resistance thereto through approximately the first half of a key stroke to a snap-over point and thereafter offering minimal resistance until closing of the associated said switch means.

3. A keyboard according to claim 2, wherein said interengaging means comprises wedge means on each said body and cantilever leaves on each said key stem slidably engaging said wedge means on the associated said body.

4. A keyboad according to claim 3, wherein each said body is made of a molded thermoplastic material and each said key stem is made of a molded acetal resin.

5. A keyboard according to claim 4, wherein aid wedge means and said cantilever leaves are formed integrally, respectively, with the associated said bodies and key stems.

6. A keyboard according to claim 5, wherein each saii wedge means comprises a slanting cam surface sloping downwardly and outwardly relative to the vertical axis of the associated said key stem and terminating in a lower edge in a vertical surface joining and depending from said slanting surface, and each associated said cantilever leaf has a free lower end slidably engaging said surfaces, with said lower edge of said slanting surface defining said snap-over point.

7. A keyboard according to claim 1, wherein said aperture-defining means comprises horizontal tabs spaced below the top surface of said cover member and engaging said module bodies to prevent horizontal displacement thereof relative to said cover member, and a key button removably mounted on each said key stem for depressing the same and cooperating with the associated said tabs to limit downward movement of said buttons and prevent transmission of excessive finger depression impact forces to said switch-operating modules or said switch means.

8. A keyboard according to claim 1, wherein aid stop means comprises a bottom plate secured to said body.

9. A keyboard according to claim 8, wherein said stop means includes a flange on said key stem, and a return bumper interposed between said flange and said body.

10. A keyboard according to claim 9, wherein said key stem is molded acetal resin, said body and bottom plate are molded thermoplastic material, and said bottom plate is ultrasonic welded to said body after mounting of said key stem therein.

11. A keyboard according to claim 1, wherein each said switch-operating module comprises a contact button mounted on the lower end of the associated said key stem for limited vertical movement relative thereto, and contact button spring means normally maintaining sad contact button in extended position.

12. A keyboard acording to claim 11, wherein the lower portion of each said key stem is tubular and apertured to provide opposed ledges, and each said contact button comprises upstanding cantilever fingers having outwardly extending lugs disposed in the associated said apertures and normally held in engagement with said ledges by said contact button spring means.

13. A keyboard according to claim 12, wherein said body, key stem and contact button are molded plastics and the lower surface of the latter comprises a segment of a spherical surface having a radius of from ½ to 4 inches from a center on the vertical centerline of the associated said key stem.

14. A keyboard according to claim 12, wherein each said module comprises a key button mounted on the upper portion of each key stem for depressing the same and cooperating with said cover member to limit downward key movements, whereby only force exerted by said contact button spring means effects closing of the associated said switch means in response to key depression, and excessive depression impact forces applied to any said key button are transmitted directly to said cover member.

15. A switch-operating module removably mounted in a cover member of plastic molded to provide aperture-defining means including opposed shelves; comprising a plastic body molded to provide cantilever hooks at opposite sides with noses at their free upper ends extending outwardly to engage said shelves and frictionally retain said body in operaive position in said aperture-defining means of said cover member, and a top plate having a vertical aperture therethrough; a plastic key stem having an upper portion slidable in said aperture and flange means intermediate its ends engageable with the lower surface of said top plate; a plastic bottom plate secured to said body having a vertical aperture slidably receiving the lower portion of said key stem; and a return spring interposed between said bottom plate and said key stem flange means normally maintaining the latter in raised position in contact with said top plate.

16. In a switch-operating module according to claim 15 interengaging means molded as part of said body and said key stem, respectively, for incrementally increasing resistance to downward movement of said key stem relative to said body through approximately the first half of a complete key stem depression to a snap-over point and thereafter offering minimal resistance throughout the remaining portion of a complete key stem depression.

17. A switch-operating module according to claim 16, wherein said interengaging means comprises wedge means at opposite sides of said body and cantilever leaves at opposite sides of said key stem having free lower ends slidably engaging respective said wedge means.

18. A switch-operating module according to claim 17, wherein each said wedge means comprises a downwardly and outwadly sloping cam surfce terminating in a lower edge in a vertical surface depending therefrom, sid lower edge defining said snap-over point.

19. In a switch-operating module according to claim 18, a contact button mounted on the lower end of said key stem for limited vertical movement relative thereto, and contact button spring means normally maintaining said contact button in extended position.

* * * * *